US007685984B2

(12) United States Patent
Hendriksma et al.

(10) Patent No.: US 7,685,984 B2
(45) Date of Patent: Mar. 30, 2010

(54) MECHANICAL LASH RING FOR A SWITCHABLE VALVE TRAIN MEMBER

(75) Inventors: Nick J. Hendriksma, Grand Rapids, MI (US); John J. Burns, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 153 days.

(21) Appl. No.: 12/069,467

(22) Filed: Feb. 11, 2008

(65) Prior Publication Data

US 2009/0199803 A1 Aug. 13, 2009

(51) Int. Cl.
*F01L 1/14* (2006.01)

(52) U.S. Cl. ..... 123/90.48; 123/90.52; 123/90.39; 123/90.45; 74/569

(58) Field of Classification Search ..... 123/90.39, 123/90.44, 90.45, 90.46, 90.48, 90.52, 90.55; 74/559, 567, 569
See application file for complete search history.

(56) References Cited

U.S. PATENT DOCUMENTS 6,513,470 B1 2/2003 Hendriksma
6,578,535 B2 6/2003 Spath
7,047,925 B2 * 5/2006 Hendriksma et al. ..... 123/90.45
7,296,548 B2 11/2007 Hendriksma

* cited by examiner

*Primary Examiner*—Ching Chang
(74) *Attorney, Agent, or Firm*—Thomas N. Twomey

(57) ABSTRACT

A switchable valve train member, such as a deactivating valve lash adjuster or a deactivating hydraulic valve lifter, including a pin housing slidably disposed within an axial bore in a body. A transverse bore in the pin housing contains a retractable locking pin that engages a feature in the body including a locking surface whereby the body and the pin housing are locked together for mutual actuation by rotation of a cam lobe. A lash ring at the outer end of the body includes a portion extending into the axial bore that limits the travel of the pin housing within the body and thereby sets the internal mechanical lash in the switchable member. The axial thickness of the lash ring may be varied between assemblies to compensate for manufacturing variation in the components and is secured to the body in any of various configurations.

21 Claims, 4 Drawing Sheets

MECHANICAL LASH RING FOR A SWITCHABLE VALVE TRAIN MEMBER

TECHNICAL FIELD

The present invention relates to switchable valve train members such as deactivating hydraulic lash adjusters (DHLAs) and deactivating hydraulic valve lifters (DHVLs) in internal combustion engines; and more particularly, to an apparatus for setting internal mechanical lash in switchable valve train members.

BACKGROUND OF THE INVENTION

It is well known that overall fuel efficiency in a multiple-cylinder internal combustion engine can be increased by selective deactivation of one or more of the engine valves, especially the intake valves, under certain engine load conditions. For cam-in-block engines, a known approach to providing selective deactivation is to equip the hydraulic valve lifters for those valve trains with means whereby the lifters may be rendered incapable of transferring the cyclic motion of the engine cam into reciprocal motion of the associated valves. For an overhead-cam engine, a known approach is to equip the hydraulic lash adjusters for those valve trains with means whereby the rocker arm may be rendered incapable of transferring the motion of engine the cams into reciprocal motion of the associated valves.

Typically, a DHLA includes, in addition to the conventional hydraulic lash elimination means, a concentric inner pin housing and outer HLA body which are mechanically responsive to the force of the rocker arm as exerted by the cam lobe, and which may be selectively latched and unlatched hydromechanically to each other, typically by the selective engagement of pressurized engine oil on locking pins.

An important consideration in a DHLA is the amount of internal mechanical lash deliberately incorporated into the DHLA. In prior art DHLAs, a transverse bore in the pin housing contains the two opposed locking pins which are urged outwards of the pin housing by a pin-locking spring disposed in compression therebetween to engage a circumferential groove including a locking surface in the inner wall of the HLA body whereby the HLA body and the pin housing are locked together to produce reciprocal motion of a rocker arm disposed on the DHLA. When valve deactivation is desired, the pins are withdrawn from the DHLA body by application of hydraulic fluid such as engine oil to the outer ends of the pins at pressure sufficient to overcome the force of the pin-locking spring.

Prior art DHVLs, such as shown in U.S. Pat. No. 6,578,535, typically are assembled from a top end of the DHVL body (which is closed at its bottom end) by insertion of components through the open top end and securing the components with one or more retaining rings and the like, fitting into an annular groove formed in the inner wall of the DHVL body below the open end thereof. The rings also serve to set internal mechanical lash in the DHVL by the selection of rings of appropriate thickness during assembly of the DHVL. The rings act as a mechanical stop to limit the outward motion of the pin housing prior to engagement and disengagement of the locking pins. Preferably, the lash rings permit the pin housing to travel to a position wherein the locking pins can clear the bottom surface, or ledge, of the locking feature in the DHVL body by a small amount, typically about 0.005 inches or less. Excess internal mechanical lash results in clatter and wear of the DHVL during engine operation, and can have an adverse effect on the lift characteristics of the associated valve. Thus, controlling the axial position of the underside of the retaining rings with respect to the ledge of the locking feature is of critical importance.

Typically, because of variation in manufacturing tolerances of the body, pin housing, and pins, the correct lash is obtained only by iterative trial and measurement using rings of differing thickness. However, setting the lash in this fashion is difficult, requiring repeated assembly and disassembly of the pin housing from the DHVL body because accessing the lash-setting retaining snap rings to remove the pin housing once installed is difficult and complicated.

Further, in cases where the wall of the DHVL body is thin because of packaging constraints, the presence of an inner-wall annular groove for the retaining rings near the open end of the DHVL body structurally weakens the wall of the body.

Referring to U.S. Pat. No. 6,513,470, a spring seat is shown for an external lost motion (LM) spring in a DHVL, wherein the spring seat also functions as a variable-thickness shim for setting the internal mechanical lash in each valve deactivation assembly. The spring seat is held in place by the LM spring that is captured by a spring tower. The spring seat rests on the outer end of the lifter body and also includes a cylindrical portion that extends into the lifter bore to engage the pin housing therein, the cylindrical portion being selectively varied to control mechanical lash. Thus, the seat serves to control mechanical lash without a requirement for a retaining groove in the inner wall of the lifter bore.

This latter approach for setting lash is not adaptable to current DHLAs since, in prior art DHLAs, the LM spring is internal to the assembly, and thus there is no spring seat requirement at the outer end of the body.

What is needed in the art is an improved DHLA wherein components are easily assembled, wherein mechanical lash is easily set, and wherein an annular groove for locking a retaining ring is obviated.

It is a principal object of the present invention to reduce the cost and complexity of an improved DHLA, to improve the ease and reliability of assembly thereof, and to increase the operating reliability thereof.

SUMMARY OF THE INVENTION

Briefly described, a DHLA in accordance with the present invention includes a conventional hydraulic lash adjustment mechanism disposed within a plunger slidably disposed within a pin housing that is slidably disposed within an axial bore in a lifter body. A transverse bore in the pin housing contains two opposed, selectively-retractable locking pins that engage a circumferential groove including a locking surface in the lifter body whereby the lash adjuster body and the pin housing are locked together for mutual actuation by rotary motion of the cam lobe to produce reciprocal motion of an engine RFF pivotably disposed on a domed head of the plunger.

A lash ring disposed at the outer end of the DHLA body and surrounding the pin housing includes a portion extending into the bore in the DHLA body to engage the pin housing. The lash ring thus functions to limit the travel of the pin housing within the DHLA body and thereby sets the internal mechanical lash in the deactivation mechanism. The lash ring may be provided as an inexpensive two-part ring, the first part being a standard-thickness ring and the second part being a shim having a thickness selected to provided a predetermined amount of mechanical lash in the assembled lifter. Preferably, the lash ring is provided as a single ring of desired thickness, which thickness varies from assembly to assembly to compensate for manufacturing variation in the components. The lash ring may be secured to the body in any of various configurations.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
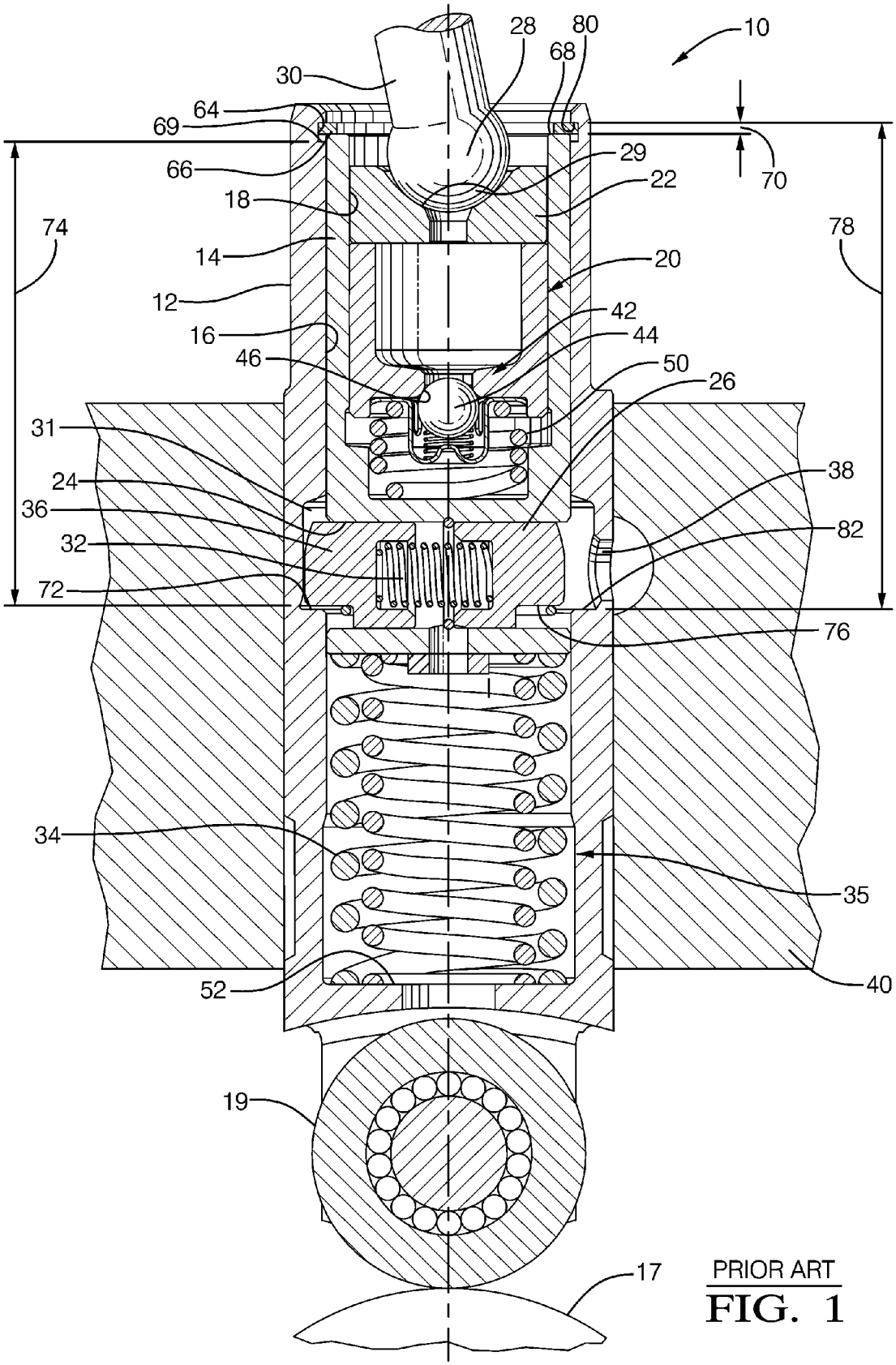
PRIOR ART FIG. 1
FIG. 1 is an elevational view of a DHVL for use in cam-in-block internal combustion engine, substantially as disclosed in U.S. Pat. No. 6,578,535 B2, showing the pin housing retained by a lash clip disposed in an annular groove in the inner wall of the DHVL body.

Referring to FIG. 1, a prior art DHVL 10 is shown, substantially as disclosed in U.S. Pat. No. 6,578,535, the relevant disclosure of which is incorporated herein by reference. DHVL 10 has a generally cylindrical body 12. A pin housing 14 is slidably disposed within a first axial bore 16 in body 12. Pin housing 14 itself has a second axial bore 18 for slidably receiving a plunger 20 having a pushrod seat 22 for receiving an end 28 of a valve actuator such as pushrod 30 in cam-in-block engine valve train (not shown). Pin housing 14 has a transverse bore 24 slidably receivable of two opposed locking pins 26 separated by a pin-locking spring 28 disposed in compression therebetween. First axial bore 16 in body 12 is provide with an engagement feature such as circumferential groove 31 for receiving the outer ends of locking pins 26, thrust outwards by spring 28 when pins 26 are axially aligned with groove 31. In such configuration, DHVL 10 is in valve-activation mode. (FIG. 1 is a split view of DHVL 10. The left side shows DHVL 10 in a valve activation mode; the right side shows DHVL 10 in a valve deactivation mode). An LM spring 34 is disposed within a chamber 35 below pin housing for absorbing lost motion of pin housing 14 within bore 16 when DHVL 10 is in deactivation mode.

Groove 31 further defines a reservoir for providing high pressure oil against the outer ends 36 of locking pins 26 to overcome spring 28 and retract the locking pins into bore 24, thereby unlocking the pin housing from the adjuster body to deactivate the DHLA. In use, groove 31 is in communication via at least one port 38 with an oil gallery (not shown) in an engine 40, which in turn is supplied with high pressure oil by an engine control module (not shown) under predetermined engine parameters in which deactivation of valves is desired.

Plunger 20 includes a hydraulic lash adjuster (HLA) mechanism 42 lodged at an inner end thereof. The arrangement of components and operation of HLA mechanism 42 has been well known in the prior art for many years. HLA mechanism 42 comprises a spring loaded check ball 44 lodged against a seat 46 formed in plunger 20 separating a low-pressure oil reservoir 48 from a high-pressure chamber 50 formed between HLA mechanism 42 and pin housing 14. Oil may be supplied to low pressure reservoir 48 annular chamber 51 from an engine oil gallery (not shown) via hollow passage 29 in pushrod 29.

In operation, prior art DHVL 10 is disposed in a bore in engine 40 such that housing 12 is free to move up and down in the bore. When the associated cam 17 exert force on roller 19, in lost motion (valve-deactivation) mode, plunger 20 and pin housing 14 are forced into body 12 in a lost-motion stroke, compressing LM spring 34.

Of particular interest to the present invention is the means by which the outward stroke of pin housing 14 is limited in prior art body 12. An annular groove 64 formed in bore 16 near the outer end thereof receives a retaining clip 66 that extends into bore 16 to engage the upper end 68 of pin housing 14. The axial thickness 70 of clip 66 is selected from a family of such clips having differing thicknesses to set the amount of axial mechanical lash 72 in DHVL 10. As described above, the amount of lash 72 is an important manufacturing parameter which must be calibrated for each DHVL assembly because of manufacturing variability in the length 74, from lower end 69 of groove 64 to the lower edge 76 of pins 26, and length 78, from the upper edge 80 of groove 64 to the lower edge 82 of groove 31. The trial-and-error method of assembly, measurement, disassembly, reassembly, and remeasurement is time-consuming, costly, and difficult when using prior art groove 64 and clip 66. Further, the presence of groove 64 in the inner wall of bore 16 at this location is undesirable as the groove weakens the wall and, if the wall is already thin, can result in failure by rupture of the small flange remaining between the upper end of the groove and the end of body 12.

Figure 2:
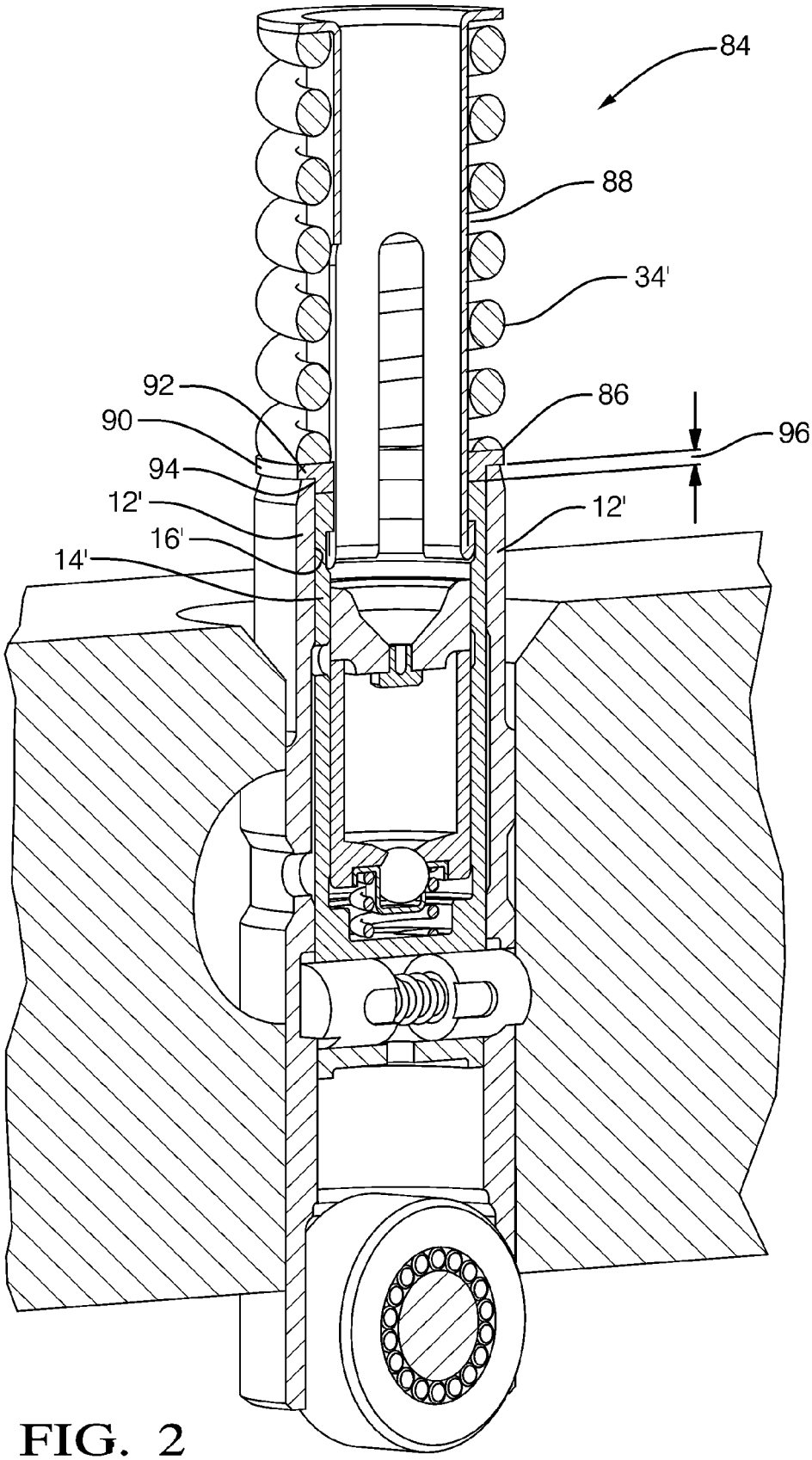
FIG. 2 is an elevational cross-sectional view of a prior art valve-deactivating hydraulic valve lifter for use in a cam-in-block engine, substantially as disclosed in U.S. Pat. No. 6,513,470 B1, showing the internal mechanical lash being set by a lost-motion spring seat without resort to an annular groove in the inner wall of the DHVL body.
Figure 3:
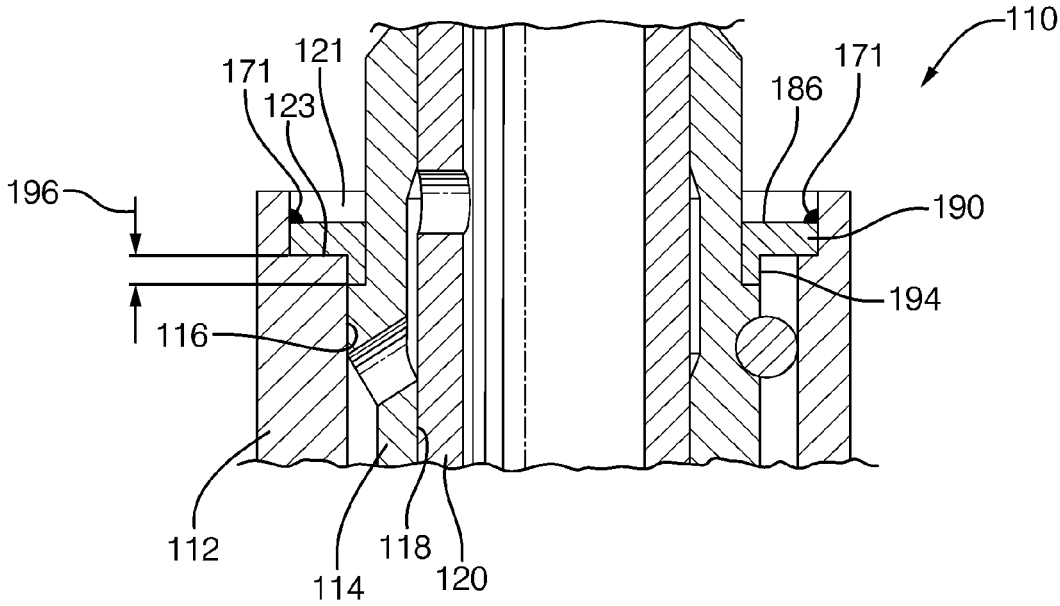
FIG. 3 is an elevational view of a central portion of a first embodiment of a DHLA in accordance with the present invention, providing a first means for securing a lash ring to the DHLA body.
Figure 4:
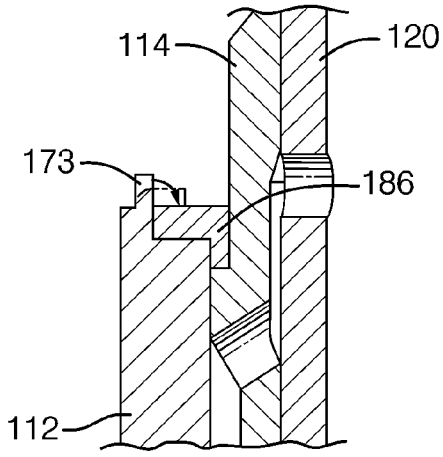
FIG. 4 is an elevational view of a central portion of a DHLA in accordance with the present invention, providing a second means for securing a lash ring to the DHLA body.

Referring now to FIG. 2, a prior art DHVL 84 is shown substantially as disclosed in U.S. Pat. No. 7,296,548 B1, the relevant disclosure of which is incorporated herein by reference. DHVL 84 comprises all of the elements shown in DHVL 10 in FIG. 1, except that the lost motion spring 34' is disposed externally of body 12' on a spring seat 86 retained by spring 34' and spring tower 88.

Spring seat 86 comprises a flange portion 90 that rests on the upper end 92 of body 12' and a cylindrical portion 94 that extends axially into bore 16' in body 12' to engage pin housing 14'. Thus, the axial length 96 of cylindrical portion 94 defines a gauge that sets the internal mechanical lash (not visible in FIG. 2) for DHVL 84.

It is an object of the present invention to adapt to a switchable valve train member DHLA the principles for setting internal mechanical lash as disclosed by DHVLs 10 and 84, with important improvements thereto, thereby simplifying the setting of lash, and strengthening the wall of the switchable valve train member as seen as a shortfall in the groove design disclosed in DHVL 10.

For simplicity of presentation, the improved mechanical lash setting mechanism is shown adapted to a DHLA. However, it is understood that the improvements can be applied to other switchable valve train members, such as DHVLs, with equal resulting benefits.

Referring now to FIGS. 3 through 9, a first embodiment 110 of an improved DHLA in accordance with the invention comprises many components identical or analogous to those described hereinabove for prior art DHVL 10, which components bear the same identification numbers plus 100. Components which are different or significantly modified bear new numbers in the 100 and 200 series. For clarity of presentation, only a central portion of a complete DHLA in accordance with the invention is shown; however, a complete DHLA having other portions generally comporting with the locking feature disclosed above in DHVLs 10 and 84.

DHLA 110 has a generally cylindrical lash adjuster body 112. The lash adjuster body is case hardened. A pin housing 114 is slidably disposed within a first axial bore 116 in lash adjuster body 112. Pin housing 114 itself has a second axial bore 118 which in turn slidably receives a plunger 120. In the case of a DHLA, the top of the plunger is domed to provide a pivot point to a socket end of the valve actuator such as a valve train rocker arm, as known in the art. Body 112 is provided with a stepped counterbore 121 defining an axial surface 123 for receiving a flange portion 190 of a lash-setting retaining ring 186 (also referred to herein as a "lash ring"). A hard turning process may be used to remove the hardened case to expose the softer inner core for subsequent processing. A cylindrical portion 194 extends axially into bore 116 in body 112 to engage pin housing 114. Thus, the axial length 196 of cylindrical portion 194 defines a gauge that sets the internal mechanical lash (not visible in FIG. 3) for DHLA 110. As in the prior art, axial length 196 is selected to provide a specified amount of lash by compensating for manufacturing variation in various components as described above.

The remainder of the present disclosure deals with various means for securing a lash ring to the lash adjuster body after the appropriate-thickness lash ring has been selected and installed.

Figure 5:
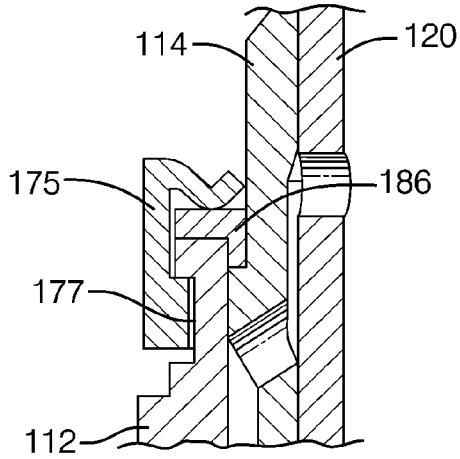
FIG. 5 is an elevational view of a central portion of a DHLA in accordance with the present invention, showing a third means for securing a lash ring to the DHLA body.
Figure 6:
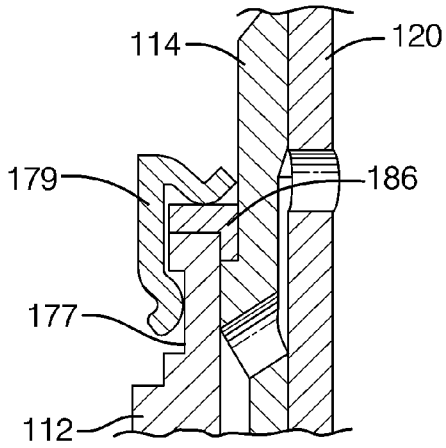
FIG. 6 is an elevational view of a central portion of a DHLA in accordance with the present invention, showing a fourth means for securing a lash ring to the DHLA body.
Figure 7:
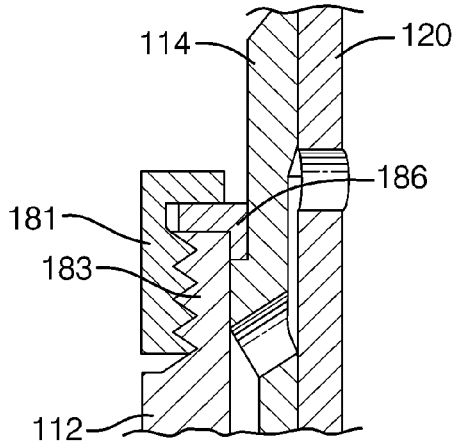
FIG. 7 is an elevational view of a central portion of a DHLA in accordance with the present invention, showing a fifth means for securing a lash ring to the DHLA body.
Figure 8:
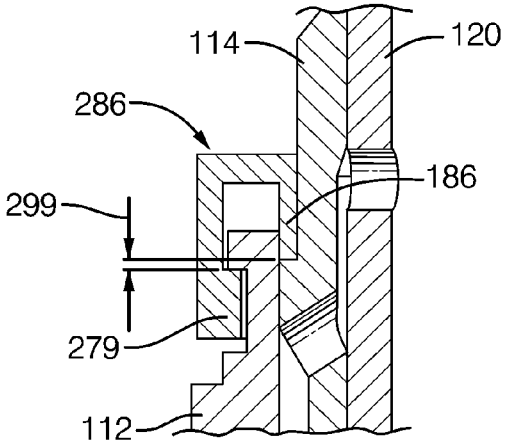
FIG. 8 is an elevational view of a central portion of a first embodiment of a DHLA in accordance with the present invention, showing a lash ring integral with a first means for securing the lash ring to the DHLA body.

Lash ring 186 may be secured to lash adjuster body 112, for example, by a weld 171, after first removing the body's hardened case in the area of the weld by the hard turning process mentioned above. (FIG. 3); by staking or crimping over a thinned extension 173 of lash adjuster body 112, after the hardened case in the area of the thinned extension is first removed by the hard turning process (FIG. 4); by providing a snap ring 175 engaged into an annular groove 177 formed in the outer surface of lash adjuster body 112 (FIG. 5); by providing a radially crushable ring 179 similar to a beverage crown cap engaged into annular groove 177 (FIG. 6); or by providing a threaded ring 181 engaged into a threaded portion 183 of lash adjuster body 112 (FIG. 7). In FIGS. 5, 6 and 7, note that the feature (annular groove 177 or threaded portion 183) formed on the outer surface of the body need not be precisely positioned or formed since the position of the lash-setting retaining ring 186 will be controlled by its mating with the axial surface of the body (123 in FIG. 4), which is readily accessible for precision machining. Further, in these embodiments, snap ring 175, crushable ring 179 and threaded ring 181 can be manufactured inexpensively as well.

Figure 9:
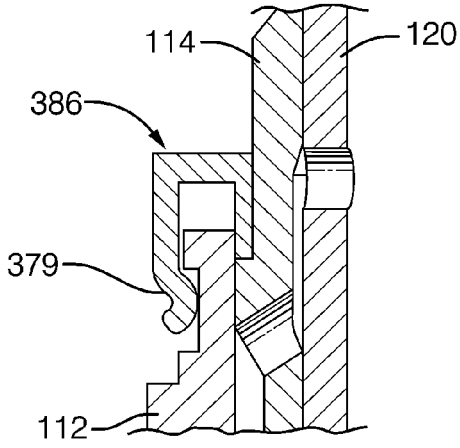
FIG. 9 is an elevational view of a central portion of a first embodiment of a DHLA in accordance with the present invention, showing a lash ring integral with a second means for securing the lash ring to the DHLA body.

A lash ring may also be provided integrally with a retaining means. For example, an integral lash retaining ring 286 may also comprise a snap ring 279 for engaging into annular groove 177 (FIG. 8), wherein offset 299 sets the internal mechanical lash; or an integral lash retaining ring 386 may also comprise a radially crushable ring 379 for engaging into annular groove 177 (FIG. 9).

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A switchable valve train member for deactivating an associated valve in an internal combustion engine, comprising:

a) a body having a first axial bore, a lock pin engagement feature and a stepped counterbore at an end of said body;

b) a pin housing slidably disposed in said first axial bore and having a second axial bore and having a transverse bore through said pin housing;

c) a plunger slidably disposed in said pin housing for engaging a valve actuator;

d) at least one locking pin slidably disposed in said transverse bore, said at least one locking pin having an outer end for selectively engaging said lock pin engagement feature in said body;

e) a lost motion spring for urging relative motion between said body and said pin housing;

f) a lash ring disposed in said stepped counterbore and secured to said body, said lash ring having a first portion thereof disposed in said first axial bore to act as a travel limiting stop for said pin housing, wherein the axial length of said first portion is selected to provide a predetermined amount of internal mechanical lash in said switchable valve train member.

2. A switchable valve train member in accordance with claim 1 wherein said lash ring is secured to said body by a weld.

3. A switchable valve train member in accordance with claim 1 wherein said counterbore includes a stakeable wall portion that may be folded inward to retain said lash ring on said body.

4. A switchable valve train member in accordance with claim 1 wherein said switchable member is a DHLA.

5. A switchable valve train member in accordance with claim 1 wherein said switchable member is a DHVL.

6. A switchable valve train member in accordance with claim 1 wherein said engagement feature is an annular groove.

7. A switchable valve train member in accordance with claim 1 wherein said valve actuator is a pushrod.

8. A switchable valve train member in accordance with claim 1 wherein said valve actuator is a rocker arm.

9. A switchable valve train member in accordance with claim 8 wherein said rocker arm is a roller finger follower.

10. A switchable valve train member for deactivating an associated valve in an internal combustion engine, comprising:

a) a body having a first axial bore, a lock pin engagement feature and a feature formed on an outer surface of said body at a first end;

b) a pin housing slidably disposed in said first axial bore and having a second axial bore and having a transverse bore through said pin housing;

c) a plunger slidably disposed in said pin housing for engaging a valve actuator;

d) at least one locking pin slidably disposed in said transverse bore, said at least one locking pin having an outer end for selectively engaging said lock pin engagement feature in said body;

e) a lost motion spring for urging relative motion between said body and said pin housing;

f) a lash ring disposed at said first end of the body and secured to said feature formed on the outer surface of the body, said lash ring having a first portion thereof disposed in said first axial bore to act as a travel limiting stop for said pin housing, wherein the axial length of said first portion is selected to provide a predetermined amount of internal mechanical lash in said switchable valve train member.

11. A switchable valve train member in accordance with claim 10 wherein said feature formed on the outer surface of the body is a groove and further comprising a snap ring disposed both against said lash ring and in said groove.

12. A switchable valve train member in accordance with claim 10 wherein said feature formed on the outer surface of the body is a groove and further comprising a radially crushable ring disposed both against said lash ring and in said groove.

13. A switchable valve train member in accordance with claim 10 wherein said feature formed on the outer surface of the body is a threaded region, further including a threaded ring disposed both against said lash ring and in said threaded region.

14. A switchable valve train member in accordance with claim 10 wherein said feature formed on the outer surface of the body is a groove and further wherein said lash ring is integral with a snap ring disposed in the groove.

15. A switchable valve train member in accordance with claim 10 wherein said feature formed on the outer surface of the body is a groove and further wherein said lash ring is integral with a radially crushable ring disposed in the groove.

16. A switchable valve train member in accordance with claim 10 wherein said switchable member is a DHLA.

17. A switchable valve train member in accordance with claim 10 wherein said switchable member is a DHVL.

18. A switchable valve train member in accordance with claim 10 wherein said valve actuator is a pushrod.

19. A switchable valve train member in accordance with claim 10 wherein said valve actuator is a rocker arm.

20. A switchable valve train member in accordance with claim 19 wherein said rocker arm is a roller finger follower.

21. An internal combustion engine comprising a switchable valve train member for deactivating an associated valve in the engine, wherein said switchable valve train member includes a body having a first axial bore, a lock pin engagement feature and a feature formed on an outer surface of said body at a first end, a pin housing slidably disposed in said first axial bore and having a second axial bore and having a transverse bore through said pin housing, a plunger slidably disposed in said pin housing for engaging a valve actuator, at least one locking pin slidably disposed in said transverse bore, said at least one locking pin having an outer end for selectively engaging said lock pin engagement feature in said body, a lost motion spring for urging relative motion between said body and said pin housing, a lash ring disposed at said first end of said body and secured to said feature formed on the outer surface of the body, said lash ring having a first portion thereof disposed in said first axial bore to act as a travel limiting stop for said pin housing, wherein the axial length of said cylindrical portion is selected to provide a predetermined amount of internal mechanical lash in said switchable valve train member.

* * * * *